US007512366B1

(12) United States Patent
Beachner et al.

(10) Patent No.: US 7,512,366 B1
(45) Date of Patent: Mar. 31, 2009

(54) APPARATUS AND METHODS FOR LOADING A DONOR ROLL UTILIZING A SLOW SPEED TRIM ROLL

(75) Inventors: James R Beachner, Webster, NY (US); Daniel M Bray, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 11/833,524

(22) Filed: Aug. 3, 2007

(51) Int. Cl.
*G03G 15/08* (2006.01)

(52) U.S. Cl. ..... 399/269

(58) Field of Classification Search ..... 399/269, 399/270, 271, 272
See application file for complete search history.

(56) References Cited

U.S. PATENT DOCUMENTS 4,131,357 A * 12/1978 Forbes, 2nd ..... 399/269
5,708,942 A * 1/1998 Sugiyama et al. ..... 399/282
5,832,350 A * 11/1998 Kumasaka et al. ..... 399/282
5,953,570 A * 9/1999 Hirai ..... 399/282
6,035,169 A * 3/2000 Miyake et al. ..... 399/258

OTHER PUBLICATIONS

Copending U.S. Appl. No. 11/686,726, filed Mar. 15, 2007, entitled "Apparatus And Methods For Loading A Donor Roll", by Ramesh et al.
Copending U.S. Appl. No. 11/686,577, filed Mar. 15, 2007, entitled "Apparatus And Methods For Loading A Donor Roll Utilizing A Slow Speed Trim Roll", by Ramesh et al.

* cited by examiner

*Primary Examiner*—Quana M Grainger
(74) *Attorney, Agent, or Firm*—Lloyd Bean, II

(57) ABSTRACT

An apparatus for loading one or more donor rolls of a developer unit, including: a developer housing having a reservoir for a developer material, the developer material comprising toner, a rotatable first donor roll that delivers the toner onto a moving photoconductive member, a rotatable trim roll that receives the developer material from the reservoir and delivers the developer material to a first magnetic brush roll that delivers the toner to the first donor roll, and a controller, responsive to a reload sensitivity signal, for controlling the speed of the trim roll.

8 Claims, 8 Drawing Sheets

APPARATUS AND METHODS FOR LOADING A DONOR ROLL UTILIZING A SLOW SPEED TRIM ROLL

CROSS-REFERENCE TO RELATED APPLICATIONS

Reference is made to commonly-assigned copending U.S. patent application Ser. No. 11/686,726, filed Mar. 15, 2007, entitled "Apparatus And Methods For Loading A Donor Roll", by Ramesh et al. and copending U.S. patent application Ser. No. 11/686,577, filed Mar. 15, 2007, entitled "Apparatus And Methods For Loading A Donor Roll Utilizing A Slow Speed Trim Roll", by Ramesh et al., the disclosures of which are incorporated herein.

BACKGROUND AND SUMMARY

This disclosure relates to maintaining print quality in xerographic developer systems. More particularly, the teachings herein are directed to apparatus and methods for loading one or more donor rolls in a developer system.

Generally, the process of electrophotographic printing includes charging a photoconductive member such as a photoconductive belt or drum to a substantially uniform potential to sensitize the photoconductive surface thereof. The charged portion of the photoconductive surface is exposed to a light image from a scanning laser beam, a light emitting diode (LED) source, or other light source. This records an electrostatic latent image on the photoconductive surface. After the electrostatic latent image is recorded on the photoconductive surface, the latent image is developed in a developer system with charged toner. The toner powder image is subsequently transferred to a copy sheet and heated to permanently fuse it to the copy sheet.

The electrophotographic marking process given above can be modified to produce color images. One electrographic marking process, called image-on-image (IOI) processing, superimposes toner powder images of different color toners onto a photoreceptor prior to the transfer on the composite toner powder image onto a substrate, such as paper. While the IOI process provides certain benefits, such as a compact architecture, there are several challenges to its successful implementation. For instance, the viability of printing system concepts, such as IOI processing, require developer systems that do not interact with previously toned images.

In the developer system, two-component and single-component developer materials are commonly used. A typical two-component developer material comprises magnetic carrier granules having toner particles adhering triboelectrically thereto. A single-component developer material typically comprises toner particles. Since several known developer systems such as conventional two component magnetic brush development and single component jumping development interact with the photoconductive surface, a previously toned image will be scavenged by subsequent developer stations if interacting developer systems are used. Thus, for the IOI process, there is a need for a scavengeless or noninteractive developer systems such as the Hybrid Scavengeless Development (HSD).

In scavengeless developer systems such as HSD, developer materials are maintained in a reservoir and conveyed onto the surface of a conventional magnetic brush roll, also referred to as a mag roll, based on a magnetic field necessary to load the mag roll. Toner is conveyed from the surface of the mag roll onto the donor roll. The donor roll is held at an electrical potential difference relative to the mag roll to produce the field necessary to load toner from the surface of the mag roll onto the surface of the donor roll. The toner layer on the donor roll is then disturbed by electric fields from a wire or set of wires to produce and sustain an agitated cloud of toner particles, which are attracted to the latent image to form a toner powder image on the photoconductive surface.

Current embodiments of scavengeless developer systems use a single mag roll to load two donor rolls. There are many shortfalls associated with this current method of loading donor rolls.

One area of concern is the effective life of the developer materials. The use of developer materials beyond the effective life can be exhibited by the persistent appearance of print quality defects such as streaks. As developer ages, highly charged toner fines accumulate on the wires and cause the print quality defects.

Developer material aging has been observed to correlate with wire pollution voltage. A comparison of wire pollution voltage versus developer age demonstrates a "developer crash" behavior that is observed where the wire pollution voltage under sustained low area coverage printing increases suddenly as the developer ages. This problem is currently being managed with the injection of fresh toner into the developer housing, which has been shown to stabilize print quality performance. Another countermeasure is periodically cleaning the wires electrostatically against a bare donor roll. The resort to such measures would not be needed, or would be needed on a less frequent basis, if developer systems and methods were implemented to prolong the effective life of developer materials.

It has been demonstrated that developer material aging is a strong function of mag roll rotational speed. Operating at a slower mag roll speed improves developer life, and correspondingly, faster mag roll speeds are detrimental to developer life.

Donor roll loading systems typically utilize a trim blade, also referred to as a metering blade or a trim, to remove excess developer material from a mag roll to ensure an even depth of coverage with developer material before arrival at a first donor roll loading nip. In these systems, further improvements in developer life can be achieved by trimming at a slower mag roll rotational speed. It is widely believed that much of the material abuse in a developer housing happens in the trim region. Simulations of the elastic energy distribution in a development housing during operation demonstrate that the trim region is a high stress zone. The material abuse rate is proportional to the speed of the mag roll at the trim region. The material abuse rate can be minimized, and developer life extended, by operating the mag roll in which developer material is trimmed at slow rotational speeds.

Although lowering mag roll speed improves print quality with respect to the problem of developer material aging, excessively slow mag roll speeds are detrimental to print quality because of insufficient reload. Reload is the requirement to provide a sufficient supply of toner, via the mag roll, to the donor loading nip. The donor loading nip is the zone in which toner is delivered from the mag roll onto the donor roll. The optimal mag roll speed is dictated by a balance between slowing down the mag roll rotational speed to extend developer material life and speeding up the mag roll rotational speed to meet the threshold requirements of reload.

An additional problem associated with print quality performance is mottle. Mottle occurs when there is poor developer material transfer efficiency, either between the mag rolls and the donor rolls (wherein toner is transferred at the donor loading nips) or between the donor roll and the photoconductive belt (wherein toner is transferred at the developer nips).

The rotational speed and direction of rotation of the donor roll rotation influences mottle. More specifically, mottle is influenced by the rotational direction of the donor roll in relation to the transport direction of the photoconductive belt, as well as in relation to the rotational direction of the mag roll. As shown in FIGS. 1 and 2, current scavengeless developer systems operate in the "against directional mode," in which the mag roll rotates in a direction that is "against" the direction in which the donor roll rotates. In addition, the current scavengeless developer systems operate in the "same directional mode," in which the donor roll rotates in the "same" direction as the direction of the photoconductive belt. It has been shown that this configuration is the worst from the point of view of mottle. In contrast, significant improvements in mottle have been demonstrated using the combination of the "with directional mode," in which the mag roll rotates in a direction that is "with" the direction in which the donor roll rotates; and the "opposite directional mode," in which the donor roll rotates in the "opposite" direction from the transport direction of the photoconductive belt.

Current scavengeless developer systems provide limited operational flexibility in simultaneously addressing the competing problems of developer life, reload and mottle to maintain acceptable levels of print quality.

There is a need for new scavengeless developer systems and methods of operating developer systems that can optimize print quality with respect to the problems of developer life, reload and mottle; at higher print speeds than are currently attainable. It is unlikely that current scavengeless developer systems can meet ambitious goals set for improved developer life and image quality improvements with respect to reload and mottle for speedup demanded in the market.

There has been provided an apparatus for loading one or more donor rolls of a developer unit, including: a developer housing having a reservoir for a developer material, the developer material comprising toner, a rotatable first donor roll that delivers the toner onto a moving photoconductive member, a rotatable trim roll that receives the developer material from the reservoir and delivers the developer material to a first magnetic brush roll that delivers the toner to the first donor roll, and a controller, responsive to a reload sensitivity signal, for controlling the speed of the trim roll.

While specific embodiments are described, it will be understood that they are not intended to be limiting. For example, even though the example given is a color process employing Image-On-Image technology, the disclosure is applicable to any system having donor rolls that are loaded by a magnetic brush, such as monochrome systems using just DC or AC/DC voltages to develop toner to the photoreceptor.

These and other objects, advantages and salient features are described in or apparent from the following detailed description of exemplary embodiments.

BRIEF DESCRIPTION OF THE DRAWINGS

Exemplary embodiments will be described with reference to the drawings, wherein like numerals represent like parts, and wherein.

DETAILED DESCRIPTION

Figure 1:
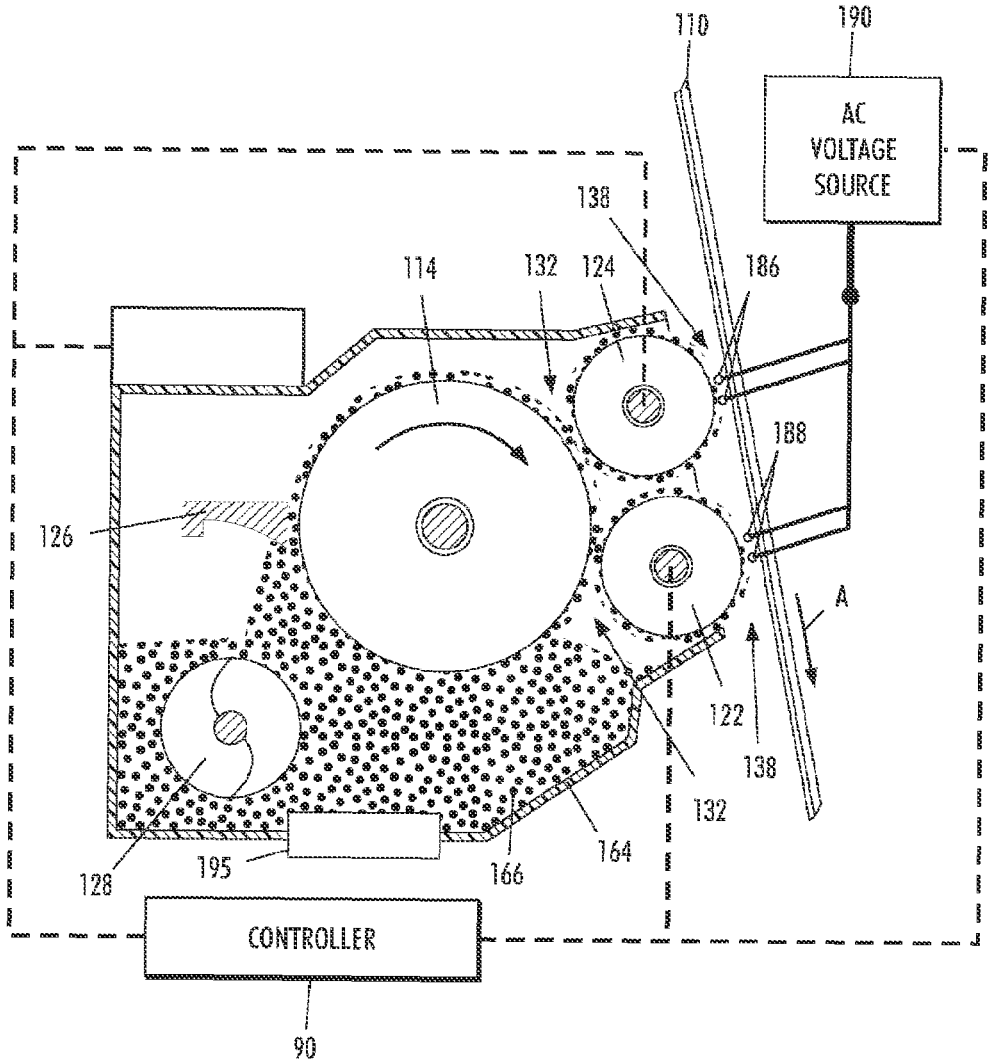
FIG. 1 PRIOR ART
FIG. 1 is a side sectional view of a conventional embodiment of a scavengeless developer system.

In the following description, reference is made to the drawings. In the drawings, like reference numerals have been used throughout to designate identical elements.

Figure 3:
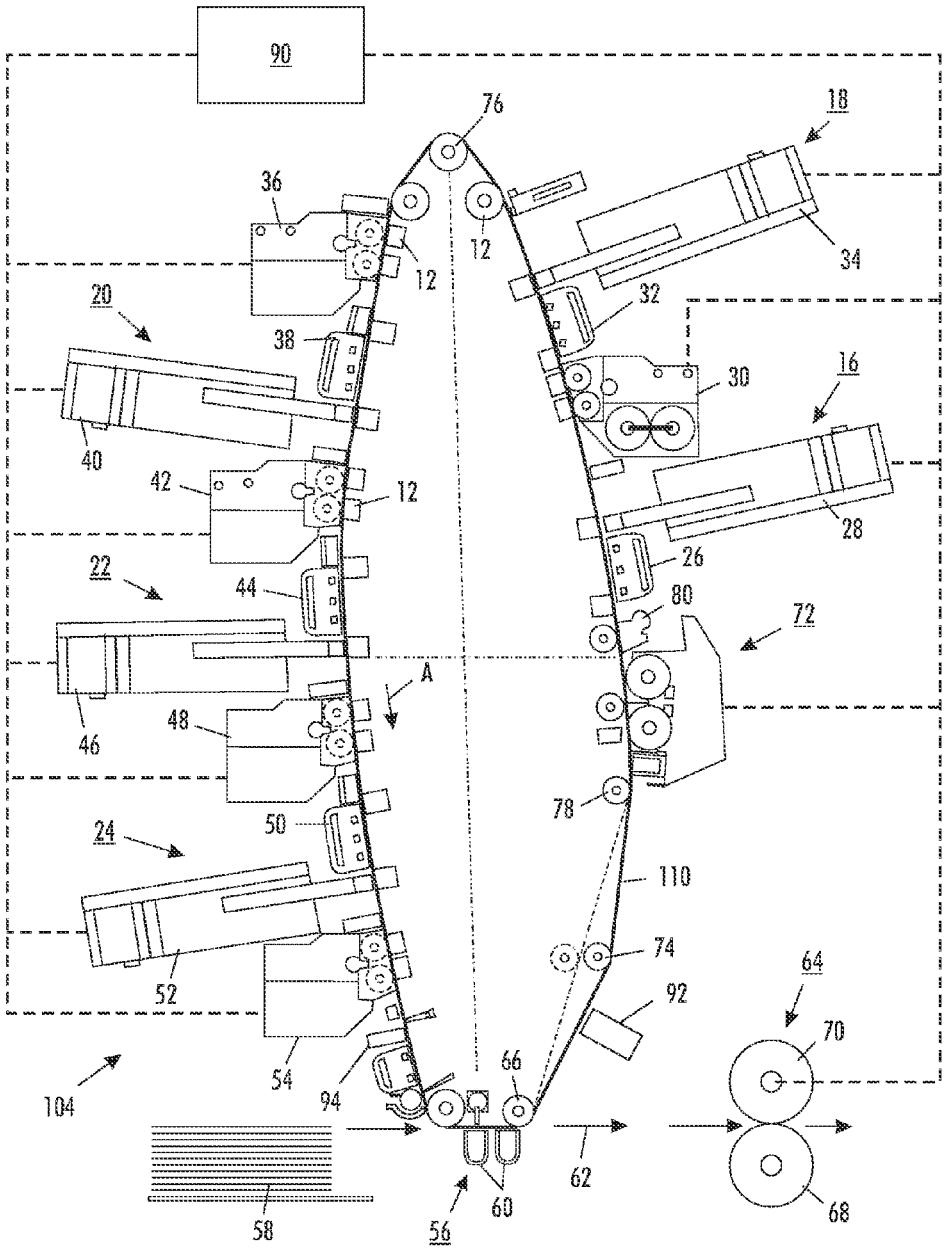
FIG. 3 is a schematic representation of an exemplary embodiment of a marking device having an exemplary embodiment of a developer system.

Referring now to the drawings, there is shown in FIG. 3 an exemplary embodiment of an Image-on-Image marking device 104 of the type of a single pass multi-color printing machine. This printing machine employs a photoconductive belt 110 supported by a plurality of rollers or bars, 12. The photoconductive belt 110 is arranged in a vertical orientation. The photoconductive belt 110 advances in the direction of arrow A to move successive portions of the external surface of the photoconductive belt 110 sequentially beneath the various processing stations disposed about the path of movement thereof. The device 104 includes five image recording stations indicated generally by the reference numerals 16, 18, 20, 22, and 24, respectively.

Initially, the photoconductive belt 110 passes through image recording station 16. Image recording station 16 includes a charging device and an exposure device. The charging device includes a corona generator 26 that charges the exterior surface of the photoconductive belt 110 to a relatively high, substantially uniform potential. After the exterior surface of the photoconductive belt 110 is charged, the charged portion thereof advances to the exposure device. The exposure device includes a raster output scanner (ROS) 28, which illuminates the charged portion of the exterior surface of the photoconductive belt 110 to record a first electrostatic latent image thereon.

This first electrostatic latent image is developed by developer unit 30. Developer unit 30 deposits toner particles, also referred to as toner, of a selected color on the first electrostatic latent image. After the highlight toner image has been developed on the exterior surface of the photoconductive belt 110, the photoconductive belt 110 continues to advance in the direction of arrow A to image recording station 18.

Image recording station 18 includes a recharging device and an exposure device. The charging device includes a corona generator 32 which recharges the exterior surface of the photoconductive belt 110 to a relatively high, substantially uniform potential. The exposure device includes a ROS 34 which illuminates the charged portion of the exterior surface of the photoconductive belt 110 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of the photoconductive belt 110. After the magenta toner powder image has been developed on the exterior surface of the photoconductive belt 110, the photoconductive belt 110 continues to advance in the direction of arrow A to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of the photoconductive belt 110 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of the photoconductive belt 110 to form a yellow toner powder image thereon. After the third electrostatic latent image has been developed with yellow toner, the photoconductive belt 110 advances in the direction of arrow A to the next image recording station 22.

Image recording station 22 includes a charging device and an exposure device. The charging device includes a corona generator 44, which charges the exterior surface of the photoconductive belt 110 to a relatively high, substantially uniform potential. The exposure device includes ROS 46, which illuminates the charged portion of the exterior surface of the photoconductive belt 110 to selectively dissipate the charge on the exterior surface of the photoconductive belt 110 to record a fourth electrostatic latent image for developer with cyan toner particles. After the fourth electrostatic latent image is recorded on the exterior surface of the photoconductive belt 110, the photoconductive belt 110 advances this electrostatic latent image to the cyan developer unit 48.

Developer unit 48 deposits cyan toner particles on the fourth electrostatic latent image. These toner particles may be partially in superimposed registration with the previously formed powder image. After the cyan toner powder image is formed on the exterior surface of the photoconductive belt 110, the photoconductive belt 110 advances to the next image recording station 24.

Image recording station 24 includes a charging device and an exposure device. The charging device includes corona generator 50 which charges the exterior surface of the photoconductive belt 110 to a relatively high, substantially uniform potential. The exposure device includes ROS 52, which illuminates the charged portion of the exterior surface of the photoconductive belt 110 to selectively discharge those portions of the charged exterior surface of the photoconductive belt 110 which are to be developed with black toner particles. The fifth electrostatic latent image, to be developed with black toner particles, is advanced to black developer unit 54.

At black developer unit 54, black toner particles are deposited on the exterior surface of the photoconductive belt 110. These black toner particles form a black toner powder image which may be partially or totally in superimposed registration with the previously formed toner powder images. In this way, a multi-color toner powder image is formed on the exterior surface of the photoconductive belt 110. Thereafter, the photoconductive belt 110 advances the multi-color toner powder image to a transfer station, indicated generally by the reference numeral 56.

At transfer station 56, a receiving medium, e.g., paper, is advanced from stack 58 by a sheet feeder and guided to transfer station 56. At transfer station 56, a corona generating device 60 sprays ions onto the backside of the paper. This attracts the developed multi-color toner image from the exterior surface of the photoconductive belt 110 to the sheet of paper. Stripping assist roller 66 contacts the interior surface of the photoconductive belt 110 and provides a sufficiently sharp bend thereat so that the beam strength of the advancing paper strips from the photoconductive belt 110. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

After the multi-color toner powder image has been transferred to the sheet of paper, residual toner particles typically remain adhering to the exterior surface of the photoconductive belt 110. The photoconductive belt 110 moves over isolation roller 78 which isolates the cleaning operation at cleaning station 72. At cleaning station 72, the residual toner particles are removed from the photoconductive belt 110. The photoconductive belt 110 then moves under a blade 80 to also remove toner particles therefrom.

Figure 2:
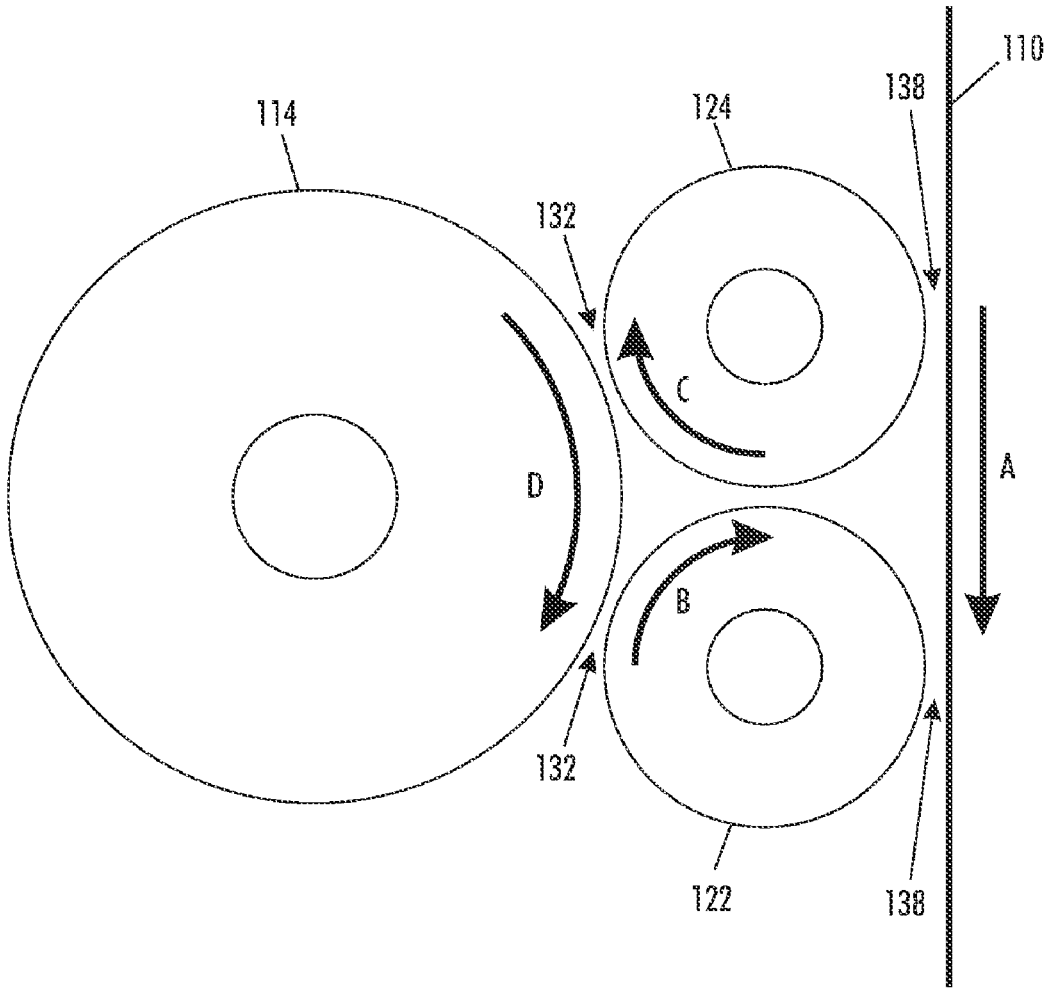
FIG. 2 PRIOR ART
FIG. 2 is a side view of a conventional embodiment of a scavengeless developer system.

Referring now to FIGS. 1, 2, and 3, there are shown details of a scavengeless developer apparatus known in the art. The apparatus comprises a developer housing having a reservoir 164 containing developer material 166. The developer material is of the two component type, meaning that it comprises conductive carrier granules and toner particles. The reservoir 164 includes one or more augers 128, which are rotatably mounted in the reservoir chamber. The augers 128 serve to transport and to agitate the developer material 166 within the reservoir 164 and encourage the toner to charge and adhere triboelectrically to the carrier granules.

The developer apparatus has a single magnetic brush roll, referred to as a mag roll 114, that transports developer material from the reservoir 164 to loading nips 132 of a pair of donor rolls 122 and 124. Mag rolls 114 are well known, so the construction of a mag roll 114 need not be described in further detail.

The mag roll 114 comprises a rotatable tubular housing within which is located a stationary magnetic cylinder having a plurality of magnetic poles arranged around its surface. The carrier granules of the developer material are magnetic, and as the tubular housing of the mag roll 114 rotates, the granules (with toner particles adhering triboelectrically thereto) are attracted to the mag roll 114 and are conveyed to the donor roll loading nips 132. A trim blade 126, also referred to as a metering blade or a trim, removes excess developer material from the mag roll 114 and ensures an even depth of coverage with developer material before arrival at the first donor roll loading nip 132 proximate the upper positioned donor roll 124. At each of the donor roll loading nips 132, toner particles are transferred from the mag roll 114 to the respective donor rolls 122 and 124.

Each donor roll 122 and 124 transports the toner to a respective developer zone, also referred to as a developer nip 138 through which the photoconductive belt 110 passes.

Transfer of toner from the mag roll 124 to the donor rolls 122 and 124 can be encouraged by, for example, the application of a suitable D.C. electrical bias to the mag roll 114 and/or donor rolls 122 and 124. The D.C. bias establishes an electrostatic field between the mag roll 114 and donor rolls 122 and 124, which causes toner to be attracted to the donor rolls 122 and 124 from the carrier granules on the mag roll 114.

The carrier granules and any toner particles that remain on the mag roll 114 are returned to the reservoir 164 as the mag roll 114 continues to rotate. The relative amounts of toner transferred from the mag roll 114 to the donor rolls 122 and 124 can be adjusted, for example by: applying different bias voltages, including AC voltages, to the donor rolls 122 and 124; adjusting the mag roll to donor roll spacing; adjusting the strength and shape of the magnetic field at the loading nips 132 and, as discussed above, adjusting the rotational speeds of the mag roll 114 and/or donor rolls 122 and 124.

At each of the developer nips 138, toner is transferred from the respective donor rolls 122 and 124 to the latent image on the photoconductive belt 110 to form a toner powder image on the latter.

In FIG. 1, at the developer nips 138 electrode wires 186 and 188 are disposed in the space between each donor roll 122 and 124 and the photoconductive belt 110. For each donor roll 122 and 124, a respective pair of electrode wires 186 and 188 extends in a direction substantially parallel to the longitudinal axis of the donor rolls 122 and 124. The electrode wires 186 and 188 are closely spaced from the respective donor rolls 122 and 124. The ends of the electrode wires 186 and 188 are attached so that they are slightly above a tangent to the surface, including the toner layer, of the donor rolls 122 and 124. An alternating electrical bias is applied to the electrode wires 186 and 188 by an AC voltage source. When a voltage difference exists between the wires 186 and 188 and donor rolls 122 and 124, the electrostatic attraction attracts the wires to the surface of the toner layer.

The applied AC voltage establishes an alternating electrostatic field between each pair of electrode wires 186 and 188 and the respective donor rolls 122 and 124, which is effective in detaching toner from the surface of the donor rolls 122 and 124 and forming a toner cloud about the electrode wires 186 and 188, the height of the cloud being such as not to be substantially in contact with the photoconductive belt 110. A DC and AC bias supply (not shown) applied to each donor roll 122 and 124 establishes electrostatic fields between the photoconductive belt 110 and donor rolls 122 and 124 for attracting the detached toner from the clouds surrounding the electrode wires 186 and 188 to the latent image recorded on the photoconductive surface of the photoconductive belt 110.

As successive electrostatic latent images are developed, the toner within the developer material is depleted. A toner dispenser (not shown) stores a supply of toner. The toner dispenser is in communication with reservoir 164 and, as the concentration of toner particles in the developer material is decreased, fresh toner particles are furnished to the developer material in the reservoir 164. The augers 128 in the reservoir chamber mix the fresh toner particles with the remaining developer material so that the resultant developer material therein is substantially uniform. In this way, a substantially constant amount of toner is in the reservoir 164 with the toner having a constant charge.

In the conventional arrangement shown in FIG. 2, the donor rolls 122 and 124 and the mag roll 114 are shown to be rotated in the "against" direction of motion. The donor rolls 122 and 124 and the photoconductive belt 110 are shown to be moving in the "same" direction of motion.

The two-component developer used in the apparatus of FIG. 2 may be of any suitable type, including electrically conductive, semi-conductive or insulative. The use of an electrically conductive developer is preferred because it eliminates the possibility of charge build-up within the developer material on the mag roll 114 which, in turn, could adversely affect developer at the second donor roll 124. By way of example, the carrier particles of the developer material may include a ferromagnetic core having a thin layer of magnetite overcoated with a non-continuous layer of resinous material. The toner particles may be made from a resinous material, such as a vinyl polymer, mixed with a coloring material, such as chromogen black. The developer material may comprise from about 95% to about 99% by weight of carrier and from about 5% to about 1% by weight of toner.

Figure 4:
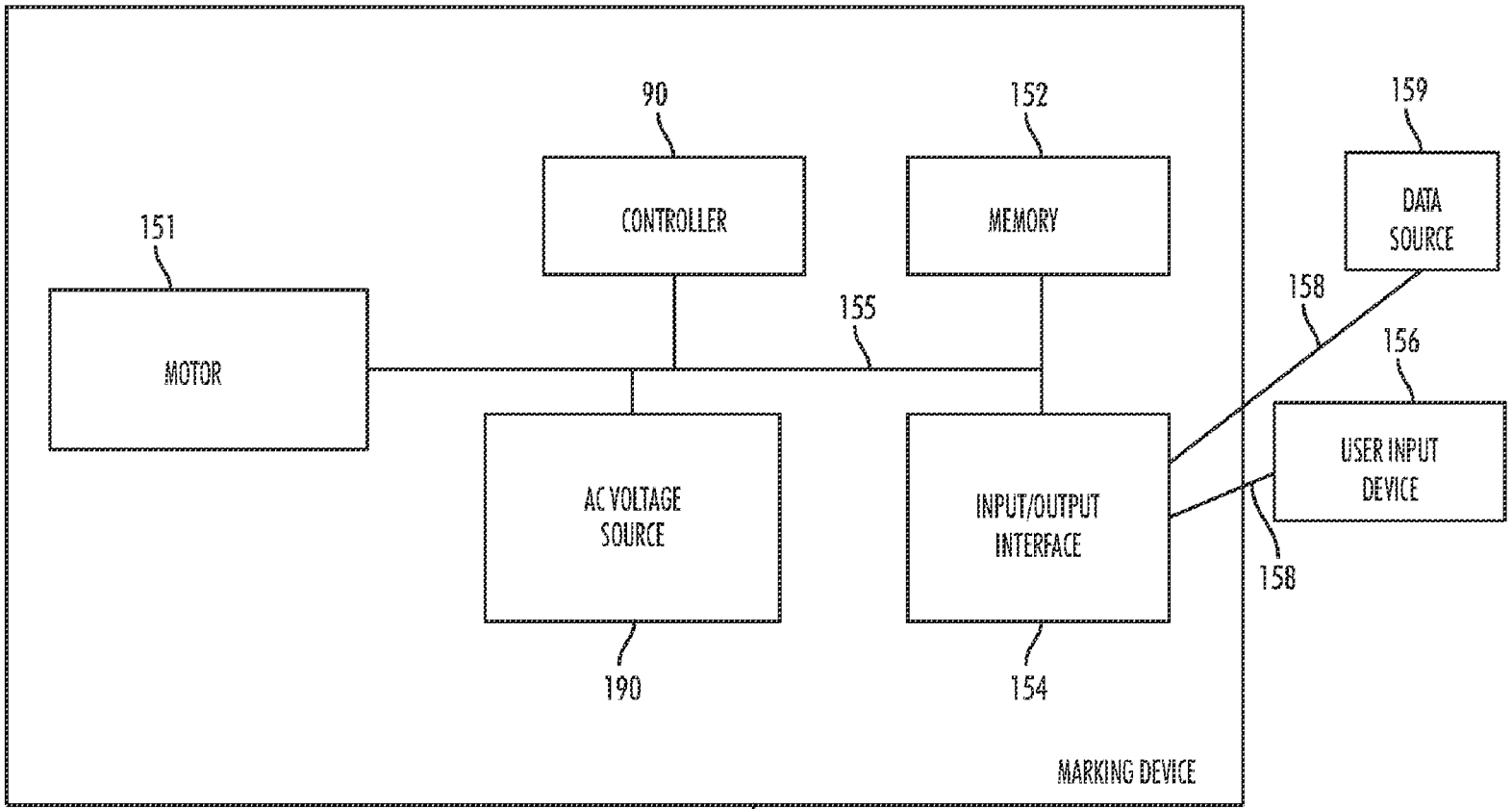
FIG. 4 is a functional block diagram illustrating an exemplary embodiment of a marking device.

FIG. 4 is a functional block diagram illustrating an exemplary embodiment of a marking device 104, which includes a controller 90, memory 152, an input/output interface 154, an AC voltage source 190 and one or more motors 151, which are interconnected by a data/control bus 155. The controller 90 controls the operation of the marking device. For example with reference to FIG. 1, the controller 90 can control operation of a developer unit, including an AC voltage source 190 and one or more motors 151 for the donor rolls 122 and 124) based in part on signals provided through an input/output interface 154.

The system controller 90 communicates with, controls and coordinates interactions between the various systems and subsystems within the machine to maintain the operation of the printing machine. That is, the system controller has a system-wide view and can monitor and adjust the operation of each subsystem affected by changing conditions and changes in other subsystems. FIG. 3 illustrates, for example, that the system controller can be used to control developer units 30, 36, 42, 48, 53; image recording stations 16, 18, 20, 22, 24; cleaning station 72 and the fuser roller 70. Although shown as a single block in FIG. 4, the system controller 90 may comprise a plurality of controller/processing devices and associated memory distributed throughout the printing device employing, for example, a hierarchical process controls architecture. The system controller 90 can employ any conventional or commonly used system or technique for controlling a print machine.

The input/output interface 154 may convey information from a user input device 156 and/or a data source 159. The controller 90 performs any necessary calculations and executes any necessary programs for implementing the marking device 104, and its individual components and controls the flow of data between other components of the marking device 104 as needed.

The memory 152 may serve as a buffer for information coming into or going out of the marking device 104, may store any necessary programs and/or data for implementing the functions of the marking system 104, and/or may store data at various stages of processing. The memory 152, while depicted as a single entity, may actually be distributed. Alterable portions of the memory 152 are, in various exemplary embodiments, implemented using static or dynamic RAM. However, the memory 152 can also be implemented using a floppy disk and disk drive, a writeable optical disk and disk drive, a hard drive, flash memory or the like. The links 158 may be any suitable wired, wireless or optical links.

The data source 159 can be a digital camera, a scanner, or a locally or remotely located computer, or any other known or later developed device that is capable of generating electronic image data. Similarly, the data source 159 can be any suitable device that stores and/or transmits electronic image data, such as a client or a server of a network. The image data source 159 can be integrated with the marking device 104, as in a digital copier having an integrated scanner. Alternatively, the data source 159 can be connected to the marking device 104 over a connection device, such as a modem, a local area network, a wide area network, an intranet, the Internet, any other distributed processing network, or any other known or later developed connection device.

Figure 5:
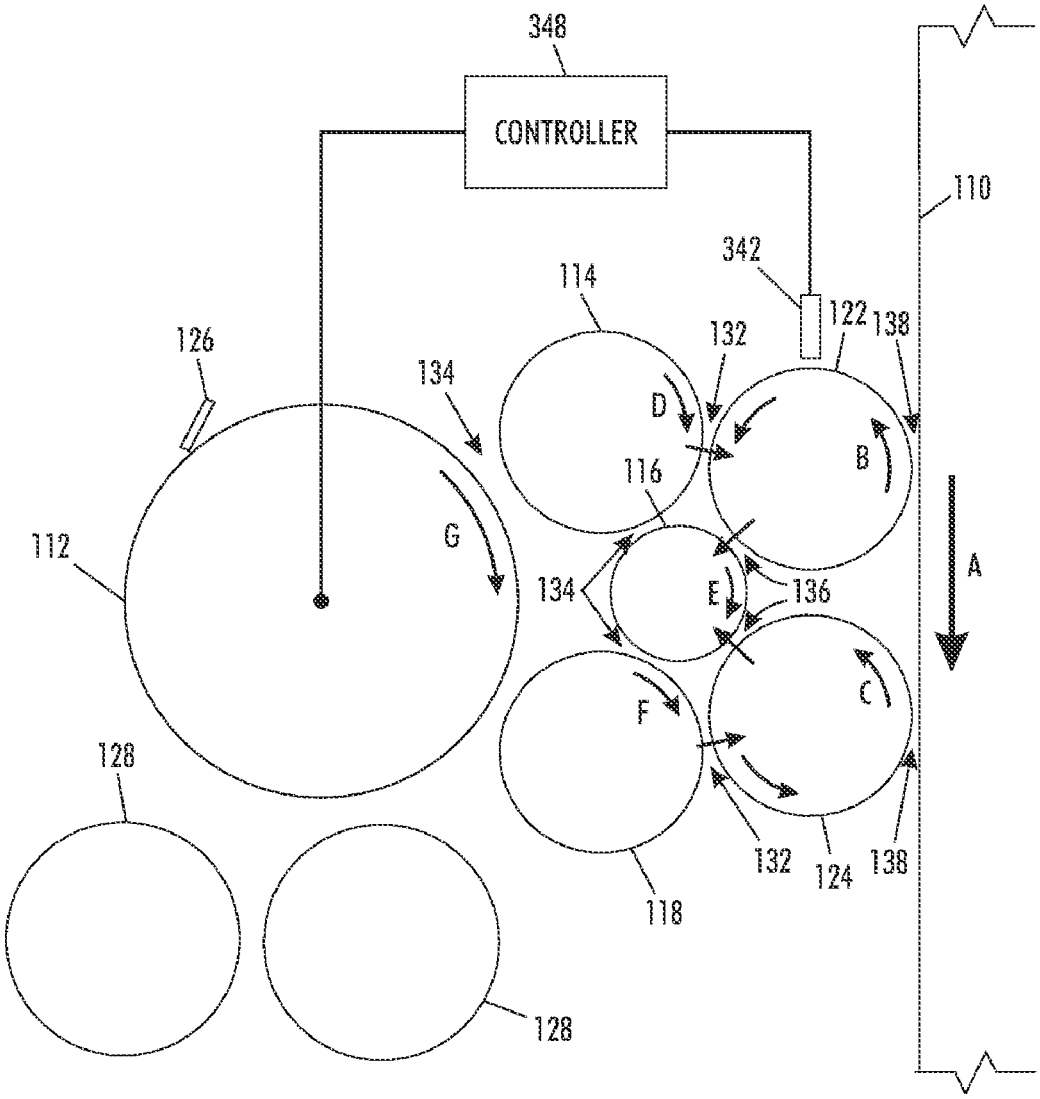
FIG. 5 is a side view of a first exemplary embodiment of a scavengeless developer system.

Referring also to FIG. 5, an apparatus for loading one or more donor rolls of a developer unit comprises a rotatable first donor roll 122 that delivers toner onto a moving photoconductive belt 110 at a developer nip 138. Also provided is a rotatable trim roll 112 that receives the developer material from the reservoir 164 and delivers the toner to the first mag roll 114 at a handoff nip 134. The first mag roll 114 transfers to the first donor roll 122 at a donor loading nip 132. A rotatable second mag roll 116 receives the developer material from the first mag roll 114 at a mag roll handoff nip 134 and delivers the toner to the first donor roll 122 at a donor loading nip. The axis of rotation of the second mag roll 116 is positioned below an axis of rotation of the first mag roll 114 so that the movement of developer material from the trim roll 112 along the mag rolls 114 and 116 is generally in the downward direction.

The apparatus may further comprise a rotatable second donor roll 124 that receives toner from the second mag roll 116 and delivers the toner onto the photoconductive belt 110 at a developer nip 138. The axis of rotation of the second donor roll 124 is positioned below an axis of rotation of the first donor roll 122.

The apparatus may further comprise a rotatable third mag roll 118 that receives developer material from the second mag roll 116 at a mag roll handoff nip 134 and delivers toner to the second donor roll 124 at a donor loading nip 132. The axis of rotation of the third mag roll 118 is positioned below an axis of rotation of the second mag roll 116.

In the embodiment shown in FIG. 5, the rotation (B, C) of the donor rolls 122 and 124 with respect to the movement (A) of the photoconductive belt 110 is in the "opposite" direction. The rotation (B, C) of the donor rolls 122 and 124 with respect to the rotation (D, E, F) of the mag rolls 114, 116 and 118 is in the "with" direction. The rotation (D) of the first mag roll 114 with respect to the rotation (G) of the trim roll 112 is in the "against" direction.

An alternate embodiment of developer apparatus shown in FIG. 5 may comprise of the two donor rolls rotating in separate directions, for instance donor roll 122 rotating in a counter-clockwise direction and donor roll 124 rotating in a clockwise direction, and vice versa.

As shown in FIG. 5, the apparatus for loading one or more donor rolls of a developer unit further comprise an overhand trim blade 126 positioned to remove excess developer material from the upper portion of the trim roll 112. The apparatus may also comprise one or more augers 128 for mixing the developer materials in the reservoir 164. The apparatus may be incorporated into a marking device such as a xerographic marking device or other marking device.

An exemplary embodiment of a developer system having a multiple mag roll loading scheme is provided to allow operational latitude to maintain print quality and address the problems associated with developer life, reload and mottle. As shown in FIG. 5, the design includes three mag rolls (114, 116, 118) with the developer material flowing down from the top mag roll to the bottom mag roll. The developer material is picked up and trimmed by the trim roll 112 and handed off to the top mag roll 114. The developer material then flows down to bottom and is released by the third mag roll 118 into the developer unit reservoir 164. The developer material is handed off between the mag rolls using magnetic fields. An overhand trim 126 is also provided for the trim roll 112. The configuration shown in FIG. 5 results in significant improvements in addressing problems associated with mottle, reload, and developer life over conventional configurations such as illustrated in FIGS. 1 and 2.

Significant improvements in reload are achieved by operating in a two mag roll loading configuration, where each donor roll is loaded by two mag rolls, in comparison to a one mag roll loading configuration. For a one mag roll loading configuration, high mag roll rotational speeds are necessary to achieve acceptable reload. Comparable reload efficiency can be achieved with two roll loading at much lower mag roll rotational speeds. The exemplary embodiments of a donor loading apparatus utilizing multiple roll loading provides operational latitude to address the problems associated with developer life, reload and mottle.

By loading the donor rolls 122 and 124 with multiple mag rolls (i.e., with at least two loading nips 132 and 136 per donor roll), acceptable reload can be achieved at lower mag roll rotational speeds, thus improving developer life. The apparatus provides for setting the rotational directions of the donor rolls and rotational speeds of mag rolls to minimize problems associated with reload, mottle and developer life.

The trim roll 112 provides a way of decoupling the developer material pickup and trim functions from the donor roll loading function. Much of the developer material abuse in a developer housing occurs in the loading and trim region. For instance, a simulation of the elastic energy distribution in a development housing suggests that the high material stress zones are in the pick up and trim regions. The developer material abuse rate is proportional to the speed of the mag rolls at the pick up and trim regions. By using an independent trim roll (112) rotating at a slower speed compared to the transport mag rolls (114, 116, 118), the developer abuse rate may be reduced.

The transport mag rolls 114, 116, 118 can be rotated at the speeds required for toner supply to the loading nips 132 and 136. Utilizing a trim roll 112, the pickup and trim of developer material occurs at a much slower speed compared to conventional pickup and trim utilizing mag rolls operating a faster rotational speeds. This should result in significantly lower abuse rate. Developer life is also improved by loading the donor rolls 122, 124 with multiple mag rolls (2 loading nips per donor roll), which provides acceptable reload at lower mag speeds. This configuration allows setting mag/donor and donor/PR rotational directions favorable to mottle without impacting reload. The use of trim roll 112 provides an independent way of managing material abuse without impacting donor loading. The use of a trim roll 112 also enables an overhand trim 126 in a multiple roll loading scheme which is believed to be advantageous.

The mass flow rates on the trim roll 112 and mag rolls 114, 116, 118 are related by $$U_{trimRoll}MOR_{trimRoll}=U_{magRoll}MOR_{magRoll}$$

$MOR_{mag}$ is the developer mass per unit area on the mag rolls 114, 116, 118 while $MOR_{trimRoll}$ is the developer mass per unit area on the trim roll 112. $U_{trimRoll}$ is the speed of the trim roll 112 while $U_{magRoll}$ is the speed of the mag rolls 114, 116, 118. Higher $MOR_{magRoll}$ gives high developer packing fraction in the donor loading nips 132 and 136, and results in improved reload. Lower $MOR_{magRoll}$ results in lower developer packing fraction in the donor loading nips 132 and 136, and results in more uniform toner layer on the donor rolls 122, 124 and improved mottle on prints. $MOR_{trimRoll}$ is set by the trim bar gap but could change as the material packing density varies with developer age, toner age, humidity, etc. By adjusting the trim roll speed ($U_{trimRoll}$) relative to the mag roll speeds ($U_{mag}$), $MOR_{magRoll}$ can be maintained to be uniform against machine noises such as developer age, toner age, environment etc. $U_{trimRoll}$ may also be used as a control actuator to tune print quality performance for better reload (high $MOR_{magRoll}$) or better mottle (low $MOR_{magRoll}$) based on image content or user preference.

Figure 6:
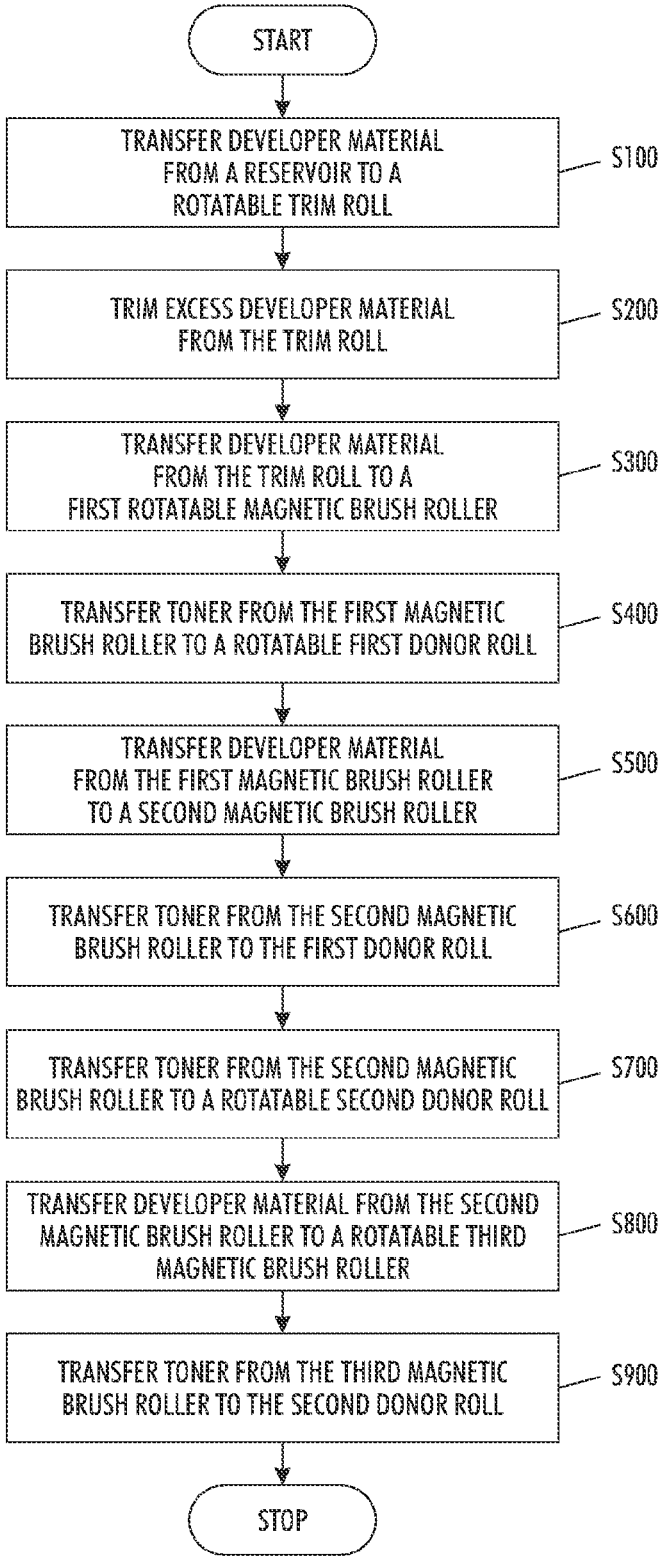
FIG. 6 is a flowchart illustrating an exemplary method of operating a developer system.

FIG. 6 provides a flowchart illustrating an exemplary method of operating a developer system, namely, a method for loading one or more donor rolls of a developer unit. In step S100, developer material is transferred from the reservoir 164 to a trim roll 112. In step S200, developer material is trimmed from the trim roll 112. In step S300, developer material is transferred from the trim roll 112 to a first rotatable mag roll 114. In step S400, toner is transferred from the first mag roll 114 to a rotatable first donor roll 122. In step S500, developer material is transferred from the first mag roll 114 to a second mag roll 116. In step S600, toner is transferred from the second mag roll 116 to the first donor roll 122. The method may further comprise step S700, wherein toner from the second mag roll 116 is transferred to a rotatable second donor roll 124; as well as step S800, wherein the developer material is transferred from the second mag roll 116 to a rotatable third mag roll 118. The method may additionally comprise step S900, wherein toner from the third mag roll 118 is transferred to the second donor roll 124.

Figure 7:
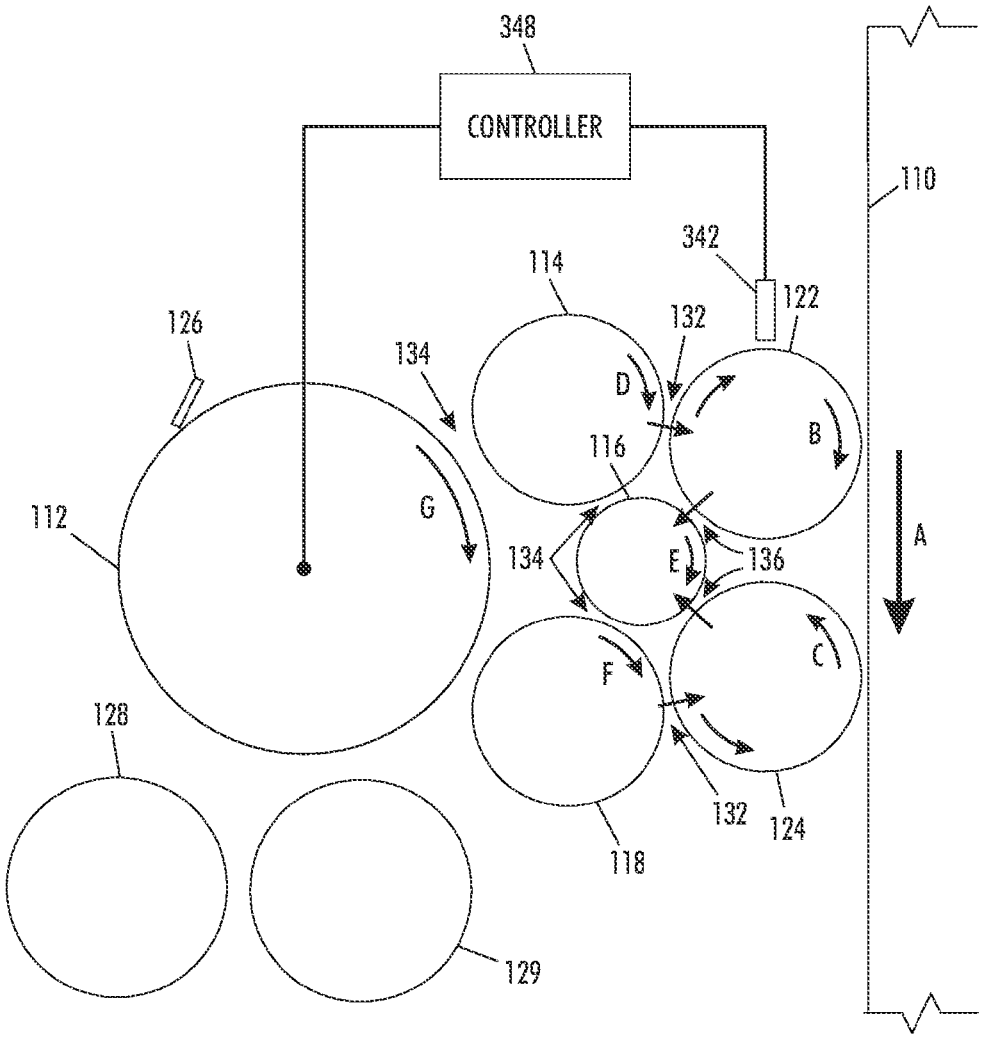
FIG. 7 is a side view of a second exemplary embodiment of a developer system.

As shown in FIGS. 1 and 7, also provided is an exemplary embodiment of an apparatus for loading one or more donor rolls of a developer unit, comprising a developer housing having a reservoir 164 for a developer material and a rotatable first donor roll 122 that delivers toner onto a moving the photoconductive belt 110 at a developer nip 138. The rotatable trim roll 112 receives the developer material from the reservoir 164 and delivers developer material to the first mag roll 114, which delivers toner to the first donor roll 122, as similarly provided in FIG. 5. In this embodiment, a rotatable second mag roll 116 is that receives the developer material from the first mag roll 114 at mag roll handoff nip 134, removes toner from the first donor roll 122 at donor unloading nip 136, and delivers developer material to a third rotatable mag roll 118 at mag roll handoff nip 134. The apparatus may further comprise a rotatable second donor roll 124 that receives toner from the third mag roll 118 at a donor loading nip 132, delivers toner onto the photoconductive belt 110 at a developer nip 138, and delivers toner to the second mag roll 116 at donor unloading nip 136. This embodiment provides cleaning of the donor rolls 122 and 124 by the second mag roll 116.

In this embodiment, the rotation (B) of the first donor roll 122 with respect to the movement (A) of the photoconductive belt 110 are in the "same" direction. The rotation (E) of the second donor roll 124 with respect to the movement (A) of the photoconductive belt 110 are in the "opposite" direction. The rotation (B) of the first donor roll 122 with respect to the rotation (D, E) of the first mag roll 114 and second mag roll 116 are in the "against" direction, and the rotation (C) of the second donor roll 124 with respect to the rotation (E, F) of the second mag roll 116 and the third mag roll 118 are in the "with" direction.

The exemplary embodiment shown in FIG. 7 provides a second, or middle mag roll 116 that unloads the donor rolls 122 and 124 while the first, i.e., top mag roll 114 and the third, i.e., bottom mag roll 118 load the donor rolls 122 and 124. This configuration requires the three mag rolls 114, 116 and 118 to be biased separately. The first mag roll 114 and the third mag roll 118 are biased to be in the develop mode while the second mag roll 116 is biased to be in the clean mode. In order to bias the mag rolls independently, semi-conductive developer materials or insulative developer materials may be required. This embodiment has the advantage of substantially reducing or eliminating the problem of reload deficiency. The rotational speed of the mag rolls and the developer nip 138 parameters (i.e., donor roll spacing, etc.) can be adjusted to optimize for problems associated with mottle and developer life.

The exemplary embodiment shown in FIG. 7 allows for the operation of the developer system in a reverse bias donor roll cleaning cycle to maintain print quality in xerographic developer systems that use donor rolls. When such systems are run with little or no toner throughput, toner on the roll becomes difficult to remove due to increased electrostatic and adhesion forces. The second mag roll 116 illustrated in FIG. 7 provides a reverse bias, to totally or partially clean the donor rolls 122 and 124, and drive the toner back to the mag roll 116.

The rotational speed of the trim roll 112 is adjusted employing a control loop for reload using Mass On Roll, MOR, as the primary actuator. Reload detector 342 measures the "reload" performance of the housing and adjust the amount of material delivered to the donor loading nip until the measurement is within a predetermined window of acceptability. This reload measurement can be accomplished by using an electrostatic voltmeter to measure the toner voltage on the donor rolls. When a development voltage step is presented to a clean donor roll, toner is developed on the roll. There is a voltage difference between the amount of toner developed on the first pass though the development nip, and after many passes. A quick measure of reload would be the ratio of the first pass toner voltage compared to the voltage step applied. Applicants have found that in general this ratio should be greater than 80% for acceptable image quality. The exact target would need to be determined by image quality testing, the results of which could be stored in a look-up table and correlated to an adjustment value. If the reload measurement is below the target, the trim roll speed is increased. If too high the speed is decreased. This allows the housing to be set up to a minimum acceptable MOR that provides adequate reload performance and minimize material and toner abuse.

This control loop function can be done in machine cycle up or at any interval as required. At step 1, the trim roll speed selector 348 control changes HSD biases to provide a loading step of known voltage level to the donor roll. At step 2, the trim roll speed selector 348 monitors reload detector 342 and calculates reload from donor loading cycle measurement and the known loading voltage level. At step 3, the trim roll speed selector 348 compares the reload value to predetermined target value, a correction signal is sent to the trim roll servo controller and setting is issued (a higher speed if below the target, a lower speed if above target). At step 4, trim roll speed selector 348 clears the donor roll by applying an appropriate voltage. At step 5, steps 1 to 4 are repeated until target is achieved. The "search style" control loop outline above is intended to show the required procedure to achieve material flow control. The procedure above could also be implemented using standard feedback control techniques. For example a PID control loop. In addition one could take an iterative approach and make small corrections while minimizing the amount of time for each correction cycle. It is preferred to have Mag rolls 114, 116, and 118 are operated at fixed speeds.

The trim roll speed selector 348 selects a rotational speed for a trim roll in the improved development system. The trim roll speed selector 348 may be implemented with one or more software modules in the controller. Alternatively, the trim roll speed selector may be comprised of software components or hardware components or it may be implemented as a stand alone component. In response to the signal from the reload detector 342, the trim roll speed selector adjusts the speed signal to the trim roll 112. As will appear, in one contemplated embodiment the speed of the roll 112 may be selected from a range of possible speeds.

Figure 8:
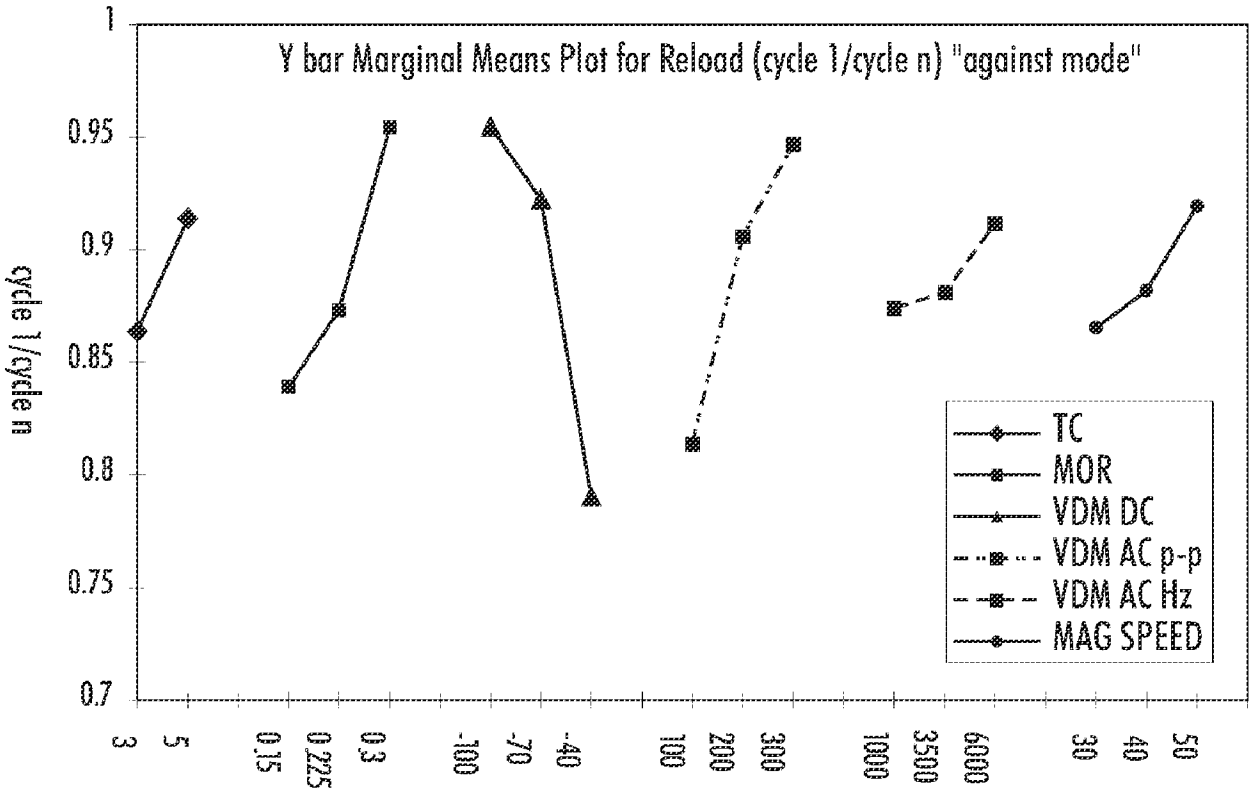
FIG. 8 illustrates a plot showing the effect of multiple factors on the reload performance in a developer system.

Referring to FIG. 8, the plot shows the effect of multiple factors on the reload performance. Reload is a measure of how well the magnetic brush can replace toner that was developed off the donor roll. It was measured with ESV looking at the surface potential of the donor, or with a density sensor that would measure the toner mass on the donor roll. The measurement was made at a point which is after the magnetic brush loading zone and before the area where toner was developed onto the photoreceptor. Reload is defined as the ratio between the first pass voltage (or mass) value and the steady state (many passes or "cycle n"). A value of 1 would correspond to perfect or 100% reload on the first pass. As the data shows very high reload numbers are achievable, but usually at the expense of high speeds and high power conditions. These conditions tend to reduce developer material and toner life. This is a major problem when the printer is running very low areas of coverage because the amount of fresh toner and material being added to the system is very low. The result is developability fall off and an increase in image noise. It is possible to dynamically adjust the run conditions to minimize these effects while still meeting the image quality needs. In the plot shown in FIG. 8, one can see the importance of MOR (mass on roll) on reload. MOR is a measure of the amount of developer on the loading magnetic brush roller. More material delivers better reload. The speed of the magnetic roller also affects the reload. Higher speed delivers better reload. High speeds and high material flows will decrease material life. By controlling the amount of material, achieved by changing the supply trim roll 112 speed, and the overall housing speed; one should be able to provide the required development, and minimized the rate of material degradation.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An apparatus for loading one or more donor rolls of a developer unit, comprising:

a developer housing having a reservoir for a developer material, the developer material comprising toner, a rotatable first donor roll that delivers the toner onto a moving photoconductive member, a rotatable trim roll that receives the developer material from the reservoir and delivers the developer material to a first magnetic brush roll that delivers the toner to the first donor roll, a controller, responsive to a reload sensitivity signal, for controlling the speed of the trim roll, and a reload detection system, in communication with said controller, for sensing reload performance of said first donor roll, said reload detection system generating one or more reload feedback signals in response to changes in reload performance of the first donor roll, said reload detection system includes an ESV for measuring changing voltage levels on said first donor roll.

2. The apparatus as described in claim 1, further comprising:

a reload detection system, in communication with said controller, for sensing reload performance of said first donor roll, said reload detection system generating one or more reload feedback signals in response to changes in reload performance of the first donor roll.

3. The apparatus as described in claim 1, wherein said first donor roll includes a plurality of wires adjacent to said surface of said first donor roll, and means for biasing said plurality of wires.

4. The apparatus as described in claim 1, wherein biasing means applies a loading bias to said first donor roll.

5. An apparatus for loading one or more donor rolls of a developer unit, comprising:

a developer housing having a reservoir for a developer material, the developer material comprising toner, a rotatable first donor roll that delivers the toner onto a moving photoconductive member, a rotatable trim roll that receives the developer material from the reservoir and delivers the developer material to a first magnetic brush roll that delivers the toner to the first donor roll, a controller, responsive to a reload sensitivity signal, for controlling the speed of the trim roll, and analyzing system, communicating with said controller, for transmitting the reload sensitivity signal to said controller; said analyzing system includes means for generating a reload value based on said ESV measurements and loading biases and means for comparing the reload value to a target value to generate said reload sensitivity signal.

6. The apparatus as described in claim 5, further comprising a magnetic roll speed selector operatively associated with said controller, said magnetic roll speed selector being capable of setting the trim roll speed as a function of the reload sensitivity signal.

7. The apparatus as described in claim 1, further comprising:

a rotatable second donor roll that receives the toner from a second magnetic brush roll and delivers the toner onto the photoconductive member, wherein an axis of rotation of the second donor roll is positioned below an axis of rotation of the first donor roll; and a rotatable third magnetic brush roll that receives the developer material from the second magnetic brush roll and delivers the toner to the second donor roll, wherein an axis of rotation of the third mag roll is positioned below an axis of rotation of the second mag roll, and wherein said first, second, and third magnetic brush roll are maintained at a constant speed.

8. A method for loading one or more donor rolls of a developer unit having a developer housing having a reservoir for a developer material, the developer material comprising toner, a rotatable first donor roll that delivers the toner onto a moving photoconductive member, a rotatable trim roll that receives the developer material from the reservoir and delivers the developer material to a first magnetic brush roll that delivers the toner to the first donor roll, comprising:

a) loading said first donor roll with toner at a predefined loading voltages;

b) measuring changes in voltages on said first donor roll;

c) determining a reload value from said measured voltages and said predefined loading voltages;

d) if said reload value is beyond a threshold value, generating a reload sensitivity signal e) adjusting the trim roll speed as a function of the reload sensitivity signal;

f) clearing said first donor roll of toner; and g) repeating steps a-f until said reload value is within said threshold value.

* * * * *